US008137151B2

(12) United States Patent
Kenney

(10) Patent No.: US 8,137,151 B2
(45) Date of Patent: Mar. 20, 2012

(54) ACTION TOY

(75) Inventor: Tyler B. Kenney, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 197 days.

(21) Appl. No.: 12/547,346

(22) Filed: Aug. 25, 2009

(65) Prior Publication Data

US 2010/0048092 A1 Feb. 25, 2010

Related U.S. Application Data

(60) Provisional application No. 61/091,613, filed on Aug. 25, 2008.

(51) Int. Cl.

| | |
|---|---|
| ***A63H 13/00*** | (2006.01) |
| ***A63H 13/06*** | (2006.01) |
| ***A63H 3/20*** | (2006.01) |
| ***A63H 33/00*** | (2006.01) |

(52) U.S. Cl. ..... 446/330; 446/4; 446/334

(58) Field of Classification Search ..... 446/4–6, 446/268, 320, 321, 330, 333–337, 376; 273/440.1, 273/459, 460, 380, 383, 440

See application file for complete search history.

(56) References Cited

U.S. PATENT DOCUMENTS

| | | | | |
|---|---|---|---|---|
| 1,605,738 | A | 11/1926 | Idemoto | |
| 1,736,163 | A | 11/1929 | McGee | |
| 1,745,434 | A | 2/1930 | McIntosh | |
| 1,781,307 | A | 11/1930 | Veronda | |
| 1,799,735 | A * | 4/1931 | Crowell | 446/334 |
| 1,812,930 | A | 7/1931 | Chester | |
| 2,088,510 | A | 7/1937 | Frasca | |
| 2,269,095 | A | 1/1942 | Davis | |
| 2,496,725 | A | 2/1950 | Hotcaveg | |
| 2,538,744 | A | 1/1951 | Berry | |
| 2,586,432 | A | 2/1952 | Land | |
| 2,716,840 | A | 9/1955 | Armstrong | |
| 2,760,306 | A * | 8/1956 | Pelletier | 446/334 |
| 3,106,800 | A | 10/1963 | Fletcher | |

(Continued)

FOREIGN PATENT DOCUMENTS

| | | | |
|---|---|---|---|
| JP | 58058095 | U | 4/1983 |

(Continued)

OTHER PUBLICATIONS

Translation (computerized) of JP H07-059940 from JPO.

(Continued)

*Primary Examiner* — Gene Kim
*Assistant Examiner* — Alyssa Hylinski
(74) *Attorney, Agent, or Firm* — Cantor Colburn LLP

(57) ABSTRACT

A toy figure for use in a game is provided, the toy having a body portion coupled to a controller movably secured to a base member that is fixedly secured to the body portion, wherein movement of the controller with respect to the base member causes a corresponding movement of the body portion with respect to the base member and movement of the base member causes a corresponding movement of the body portion and the controller; and a button disposed on the body portion, the button being capable of movement from a first position to a second position wherein movement of the button from the first position to the second position causes a pair of body parts pivotally secured to the body portion to pivot from a closed position to an opening position.

16 Claims, 8 Drawing Sheets

U.S. PATENT DOCUMENTS

| | | | | | |
|---|---|---|---|---|---|
| 3,135,444 | A | | 6/1964 | Schoenfeld | |
| 3,235,259 | A | * | 2/1966 | Glass et al. | 273/440.1 |
| 3,303,605 | A | | 2/1967 | Henry | |
| 3,758,982 | A | | 9/1973 | Lemelson et al. | |
| 3,845,956 | A | | 11/1974 | Goldfarb et al. | |
| 3,848,357 | A | | 11/1974 | Morrison | |
| 3,856,304 | A | * | 12/1974 | Matsumoto et al. | 273/440.1 |
| 3,864,870 | A | | 2/1975 | Breslow et al. | |
| 3,927,883 | A | | 12/1975 | Bosley et al. | |
| 3,969,841 | A | | 7/1976 | Joseph | |
| 4,031,657 | A | | 6/1977 | Crosman et al. | |
| 4,069,613 | A | | 1/1978 | Lemelson et al. | |
| 4,091,563 | A | | 5/1978 | Noble et al. | |
| 4,319,751 | A | * | 3/1982 | Kurushima et al. | 273/440.1 |
| 4,366,960 | A | | 1/1983 | Bromley et al. | |
| 4,367,875 | A | | 1/1983 | Barlow et al. | |
| 4,398,717 | A | | 8/1983 | Rosenfeld et al. | |
| 4,457,097 | A | | 7/1984 | Miller et al. | |
| 4,530,671 | A | | 7/1985 | Mednick et al. | |
| 4,560,362 | A | * | 12/1985 | Renger | 446/340 |
| 4,609,195 | A | * | 9/1986 | Ham | 273/440.1 |
| 4,673,367 | A | * | 6/1987 | MacBain | 446/4 |
| 4,844,461 | A | | 7/1989 | Namanny et al. | |
| 4,995,610 | A | | 2/1991 | Paoletti | |
| 5,009,424 | A | * | 4/1991 | Harth et al. | 273/440.1 |
| 5,042,807 | A | | 8/1991 | Sasakawa et al. | |
| 5,046,987 | A | | 9/1991 | Djordjevic | |
| 5,181,727 | A | | 1/1993 | Fukumura | |
| 5,458,523 | A | * | 10/1995 | Aoki et al. | 446/246 |
| D387,822 | S | | 12/1997 | Dawson | |
| 5,732,953 | A | * | 3/1998 | Tamura | 273/440.1 |
| 5,921,839 | A | * | 7/1999 | Siren | 446/7 |
| 5,989,094 | A | | 11/1999 | Tamura | |
| 6,238,215 | B1 | | 5/2001 | Jurmain et al. | |
| 6,280,286 | B1 | | 8/2001 | Andrews | |
| 6,682,392 | B2 | | 1/2004 | Chan | |
| 7,475,881 | B2 | * | 1/2009 | Blagg et al. | 273/440.1 |

FOREIGN PATENT DOCUMENTS

| | | | | |
|---|---|---|---|---|
| JP | 06154418 | A | | 6/1994 |
| JP | 07059940 | A | * | 3/1995 |
| JP | H07-059940 | A | | 3/1995 |
| JP | 63184088 | U | | 11/1998 |
| JP | 2003-079964 | A | | 3/2003 |

OTHER PUBLICATIONS

Translation (computerized) of JP 2003-079964 from JPO.
International Search Report for PCT/US2009/054940 dated Mar. 10, 2010.
Written Opinion of the International Searching Authority for PCT/US2009/054940 dated Mar. 10, 2010.

* cited by examiner

ACTION TOY

CROSS REFERENCE TO RELATED APPLICATIONS

This application claims the benefit of U.S. Provisional Patent Application Ser. No. 61/091,613 filed Aug. 25, 2008, the contents of which are incorporated herein by reference thereto.

BACKGROUND

Exemplary embodiments of the present invention relate generally to toy figures and particularly toy figures which include movable features for simulating fighting.

Examples of toy figures simulating fighting are disclosed in U.S. Pat. Nos. 3,235,259 and 7,475,881, the contents each of which are incorporated herein by reference thereto.

Other examples of toys simulating boxing matches are disclosed in U.S. Pat. Nos. 2,269,095; 2,716,840; 3,106,800; 3,856,304; 4,031,657; 4,069,613; 4,366,960; 4,367,875; 4,995,610; and 5,732,953, the contents each of which are incorporated herein by reference thereto.

It is desirable to provide toys with new features in order to improve upon existing toys to provide users with more variations in play.

SUMMARY

In one non-limiting exemplary embodiment a toy figure for use in a game is provided, the toy having a body portion coupled to a controller movably secured to a base member that is fixedly secured to the body portion, wherein movement of the controller with respect to the base member causes a corresponding movement of the body portion with respect to the base member and movement of the base member causes a corresponding movement of the body portion and the controller; and a button disposed on the body portion, the button being capable of movement from a first position to a second position wherein movement of the button from the first position to the second position causes a pair of body parts pivotally secured to the body portion to pivot from a closed position to an opening position.

In another exemplary embodiment, a game is provided, the game having a base; a first fighting figure movably secured to the base, the first fighting figure having: a body portion coupled to a controller movably secured to a base member that is fixedly secured to the body portion, wherein movement of the controller with respect to the base member causes a corresponding movement of the body portion with respect to the base member and movement of the base member causes a corresponding movement of the body portion and the controller; a button disposed on the body portion, the button being capable of movement from a first position to a second position wherein movement of the button from the first position to the second position causes a pair of body parts pivotally secured to the body portion to pivot from a closed position to an open position; and a second fighting figure movably secured to the base, the second fighting figure having: a body portion coupled to a controller movably secured to a base member that is fixedly secured to the body portion, wherein movement of the controller with respect to the base member causes a corresponding movement of the body portion with respect to the base member and movement of the base member causes a corresponding movement of the body portion and the controller; and a button disposed on the body portion, the button being capable of movement from a first position to a second position wherein movement of the button from the first position to the second position causes a pair of body parts pivotally secured to the body portion to pivot from a closed position to an open position.

BRIEF DESCRIPTION OF THE DRAWINGS

Exemplary embodiments of the present invention are described herein with reference to the accompanying drawings; in which.

DETAILED DESCRIPTION OF EXEMPLARY EMBODIMENTS

Figure 1:
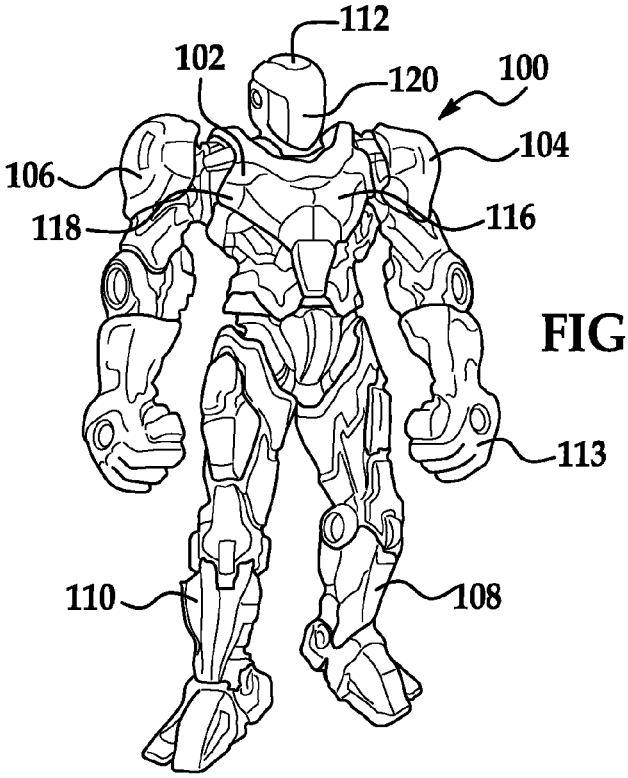
FIG. 1 is a front perspective view of a toy figure in accordance with one embodiment of the present invention.
Figure 2:
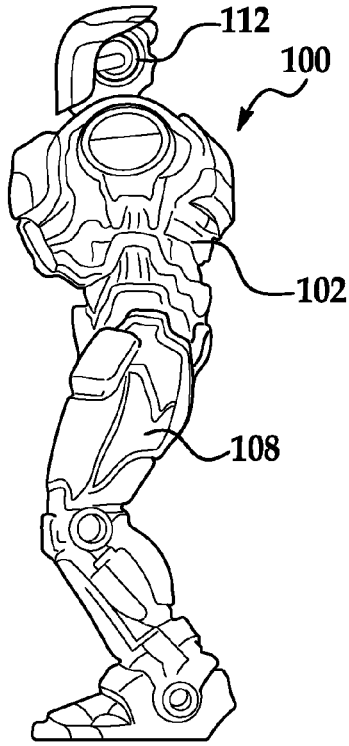
FIG. 2 is a side elevational view of the toy figure of FIG. 1 with the articulating arms removed.
Figure 3:
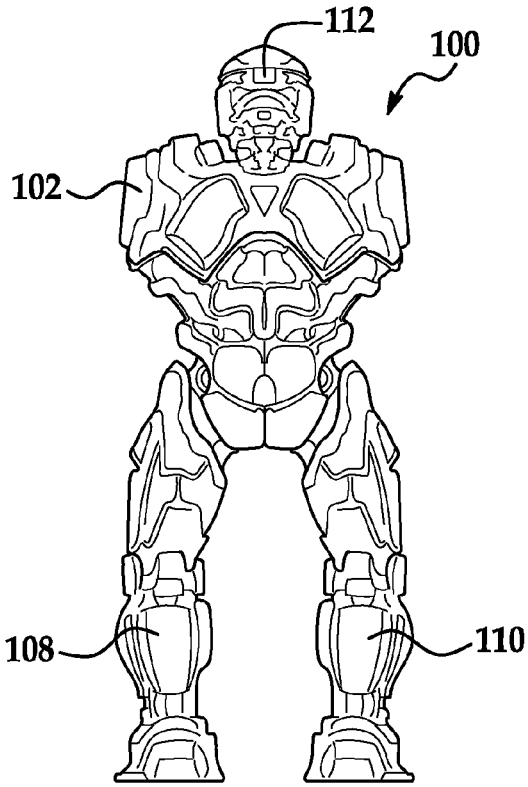
FIG. 3 is a back elevational view of the toy figure of FIG. 2.

In one exemplary embodiment, movable toy figures are provided wherein the toy figures are configured to simulate a boxing match or other type of fight. In some embodiments, the toy figure has body, head portions and/or any other portions that articulate or move when triggered.

As illustrated in FIGS. 1-5, a toy figure 100 is illustrated and generally configured to appear as a robot having a body portion 102, a first arm 104, a second arm 106, a first leg 108, a second leg 110, a head 112 and a neck 114; however, toy 100 may take the form of any suitable toy, figure or character and is not limited to the toy figures described herein.

Toy 100 may be coupled to a platform to simulate a boxing match or other type of ring, cage or other enclosed or substantially enclosed fighting venue. In one embodiment, toy 100 faces off against another toy that is similar in configuration and operation. Therefore, only one toy figure will be described herein. It will be appreciated however, that each toy figure may have a unique or different appearance from the other toy figure and may have varying movable portions thereon.

Preferably, arms 104 and 106 articulate or move to simulate fighting or punching and are movable independently from each other. As one of ordinary skill in the art will appreciate, the arms may be movable via a series of gears and levers that couple to external switches, buttons or other devices to activate the movement. In embodiments in which the arms are individually movable, each arm is activated by a specific button or switch or other device; however, the arms can be activatable by the same switch and operate in unison. Additionally, the arms may be movable any manner desired. In one embodiment, each arm a fist 113 that may be formed or coated with urethane foam or silicone or other suitable material.

Figure 4:
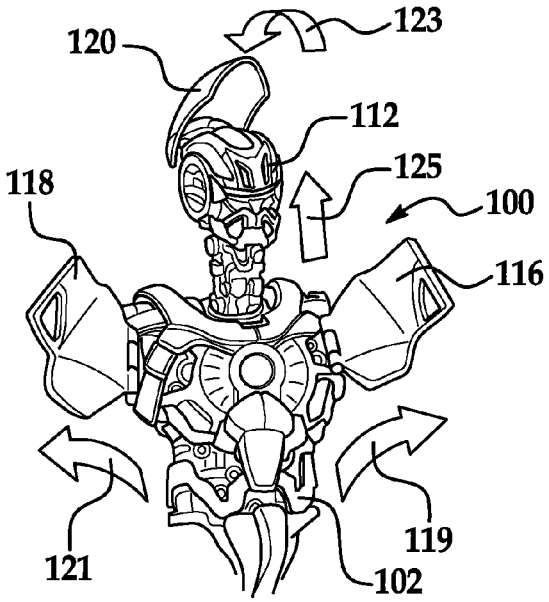
FIG. 4 is a partial perspective view of the toy figure of FIG. 2 with the neck extended and the chest and helmet portions open.

Preferably, as illustrated in FIG. 4, the body portion 102 includes a first movable chest portion 116 and a second movable chest portion 118. Each movable chest portion may be hingedly or pivotally coupled to the body portion, such that it is capable of swinging outwardly with one end remaining coupled or connected to the body portion 102. The hinges coupling the movable chest portions to the body portion may be spring activated, generally hinging one end of the movable chest portions outwardly and away from body portion 102, as indicated by arrows 119 and 121 in FIG. 4. In one embodiment, the movable chest portions latch or couple to the body portion upon closure, as shown in FIG. 1. It is noted that the movable chest portions do not necessarily need to be spring activated and can open or separate fully or partially from the body 102 in any manner or direction desired.

Figure 5:
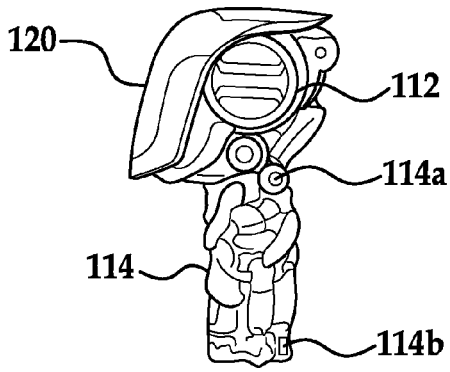
FIG. 5 is side elevation view of the head and neck portion of the toy figure of FIG. 4.

Further, as illustrated in FIG. 4, in one embodiment, head 112 includes a mask, visor or head portion 120 that is spring activated and may flip upwardly and backwardly, indicated by arrow 123. Preferably, mask portion or visor 120 couples or latches to the head, so that it may remain in a downward or closed position, as shown in FIGS. 1 and 5. It is noted that the mask portion does not necessarily need to be spring activated and can open or separate fully or partially from the head in any manner or direction desired.

As shown in FIG. 5, neck 114 is preferably an elongate section or extension that at first end 114*a* is coupled to the head 112 and at second end 114*b* may be inserted into body portion 102. Neck and/or head engage a spring or other device that biases the head 112 upwardly relative to body 102. This allows neck 114 to slide upwardly relative to body 102, as indicated by arrow 125, in FIG. 4. In a downward position (i.e. when neck 114 is inserted in body 102 and head 112 is adjacent body portion 102), the neck and/or head engage a latch or other mechanism that retains the head in the downward position, as in FIGS. 1-3. The head 112 may extend upwardly or move or rotate in any manner disclosed and described in the above referenced U.S. Pat. Nos. 3,235,259 and 7,475,881, each of which have been previously incorporated by reference.

Figure 6:
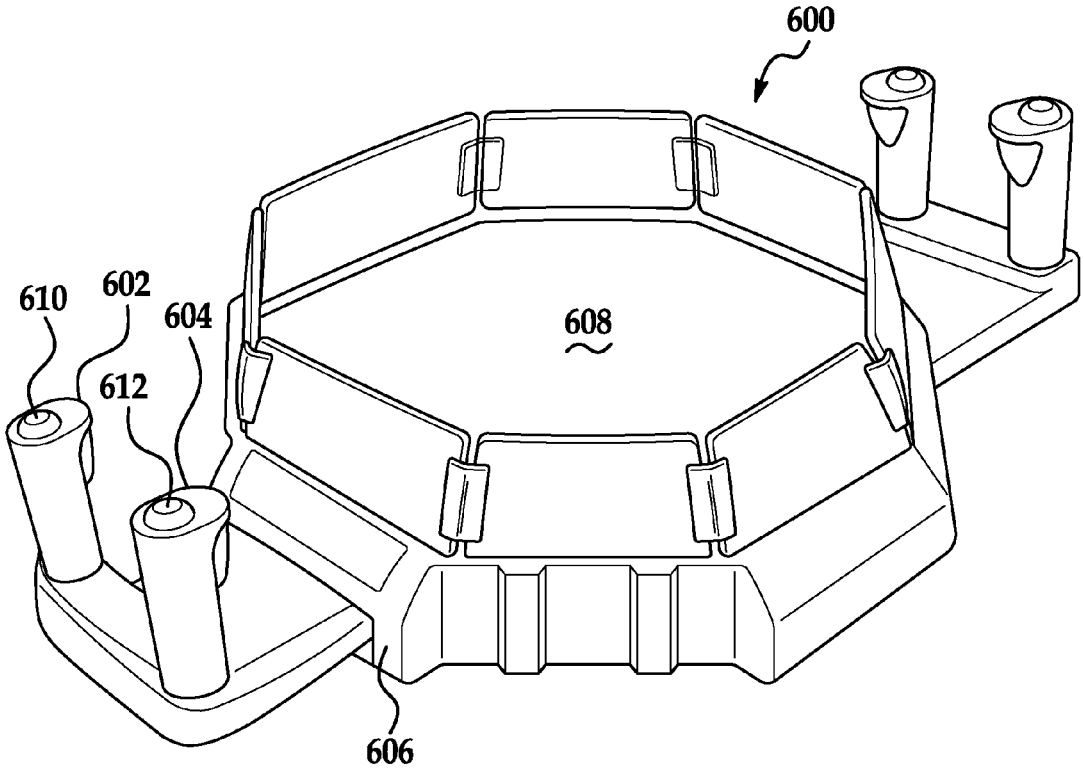
FIG. 6 is a top perspective view of a fighting ring in which the toy figure of FIG. 1 is positioned.

In one embodiment, the toy 100 is configured to couple to and be positioned on a platform 600 (FIG. 6). In this embodiment, handles 602 and 604 are for manipulation of the toy 100 and extend through the side 606 of the platform and terminate at the floor 608 of the platform. The platform may have an opening or openings thereon that allow two or more two figures to be positioned on or adjacent the platform. That is, each figure may be coupled to a respective handle through the opening or openings; however, it is not necessary for the platform to have openings thereon and the toy figures may be positioned on or adjacent the floor of the platform in any manner desired.

Each toy 100 may be connected to a respective handle via the bottom of one or both of the first and/or second legs 108, 110. As one skilled in the art would appreciate, in one embodiment, the gear mechanism in toy 100 may extend upwardly through each leg 108, 110 to a respective arm 104, 106 and through the handle or handles to a button or switch or a plurality of button or switches. The arms may be moved as disclosed in previously discussed U.S. Pat. No. 3,235,259 and/or U.S. Pat. No. 7,475,881. In addition, toy figure 100 may include one or more rod to articulate each arm and may include any number of rods (e.g. four) to move the figure in any other manner. For example, the figure may rotate/move about the waist or move in any other direction or manner. The handles and/or additional buttons or switches may be moved or activated to manipulate the figure.

Figure 9:
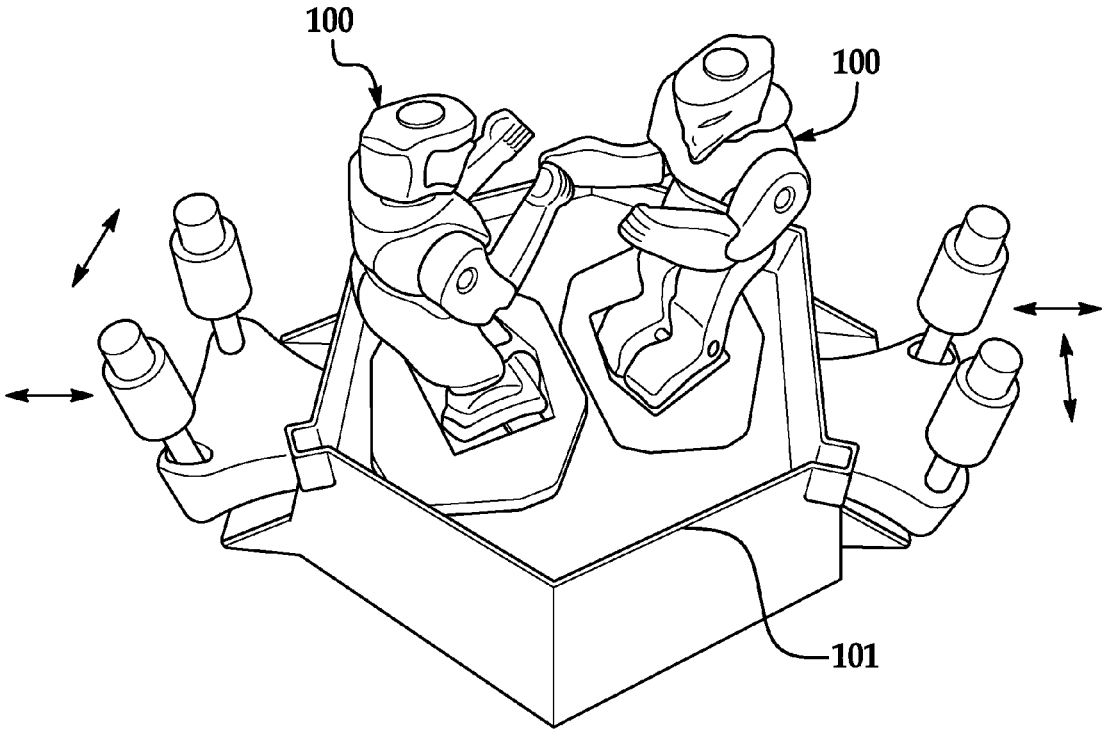
FIG. 9 is a top perspective view showing two figures simulating fighting.

Thus, during play the player may activate buttons 610 and/or 612, resulting in articulation of the arms 104 and 106 and/or movement of the toy 100 relative to the floor of the platform. One game play object is to articulate the arms of one figure in such a manner as to cause a second figure's head to extend and/or have the chest or head portions open or move relative to the head and/or body. As described herein, such objects may be accomplished by striking the opponent's figure with sufficient force and/or in a specific area. In one embodiment, as shown in FIG. 9, two figures 100 may face each other in a simulated boxing ring 101. It is noted that during game play more or less than two figures can be used and there can be any number of handles for each toy. Additionally, any number of buttons can be used and the buttons can be located in any position and on any number of handles desired or in any manner desired. For example, one button that articulates both arms may be positioned on one handle. In some embodiments, the platform includes sound and/or lights. Sounds may include a ratcheting sound when the head is extended, crowd and/or other fight noises.

In one embodiment, as illustrated in FIG. 4, the head 112 extends upwardly, the chest portions spring outwardly and the mask portion springs upwardly when a specific area of the body 102 or the head 112 is contacted. For example, a switch or sensor or other device may be positioned in the center of the chest. The switch/sensor may include a light that indicates power or if contact is made. In this embodiment, a trigger or switch is activated that releases latches holding the head 112 in a downward position and the chest portions and mask portion in a closed position. Once the latches are released a spring biases the head 112 upwardly and an additional spring or springs bias the chest portions outwardly and the mask portion upwardly. It is noted that the switch or sensor may be located in any portion of the figure and is not limited to the embodiments described herein.

In some embodiments the head 112, the movable chest portions 116 and 118 and the mask portion 120, each have a respective trigger or switch that releases the latch for each specific portion. Upon with the specific trigger only that portion moves. In other embodiments, any number of the head, movable chest portions and mask portion may be linked to the same trigger. For example, the chest and mask portions can be activated by the same trigger, while the head is activated by a separate trigger. Each of the triggers may be on any desired portion of the toy figure.

In one embodiment the head, movable chest portion and mask portion are each in a closed or down position in such a manner that a blow or strike of sufficient force will dislodge the head, chest portion or body portion and allow it to open and/or extend. In other words, there is no trigger or switch that unlatches the head or relevant portion, merely a sufficient blow or jarring of the toy will dislodge some or all of the head, movable body portions and/or the mask portion.

Figure 7:
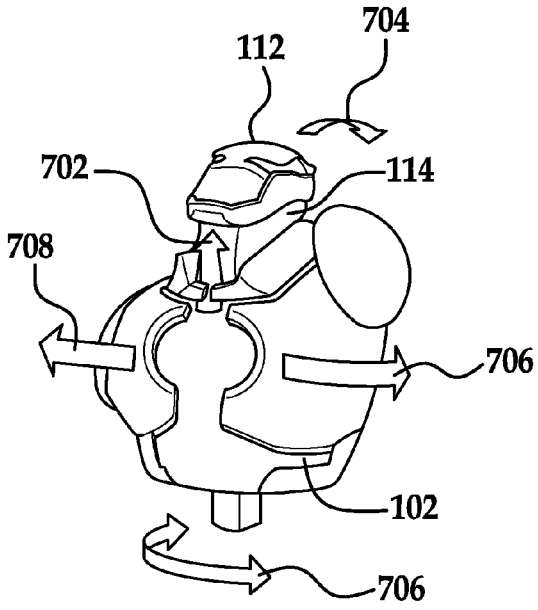
FIG. 7 a partial front perspective view of an embodiment of the present invention in which the head and body of the toy figure are capable of rotational movement.

As shown in FIG. 7 and in some embodiments, the head 112 and body 102 can rotate to simulate a reaction to being struck or for any other reason. As indicated by arrows 702 and 704, the neck 114 slides upwardly, as described above and the head rotates backwardly relative to one end of the neck 114. Additionally, the body 102 may rotate or twist side to side, as indicated by arrow 706. Such rotation and/or twisting may be accomplished through ball joints connecting the head to the neck, and an upper body portion to a lower body portion or to the legs. Such movement may provide a more realistic fight and for defensive actions. Defensive actions may be implemented by switches or handles that are connected to rods in the figure. The player may manipulate the controls to invoke twisting, bending or other movement of the figure. The ball joints may allow about 20 degrees movement from center to back and about 17 degrees from center side to side; however, the ball joint movement can be any range of movement and in any direction desired. It is noted that any portion of figure 100 can be coupled to any other portion of figure 100 using any type of suitable coupling device or mechanism. Additionally as shown in FIG. 7, in one embodiment, the chest may move laterally as indicated by arrows 706 and 708.

Figure 8A:
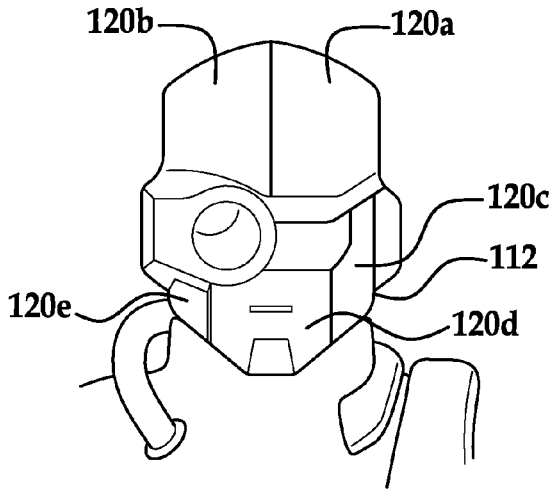
FIGS. 8*a* and 8*b* illustrate a front view of a head of a toy figure having a plurality of movable portions according to an embodiment of the present invention.
Figure 8B:
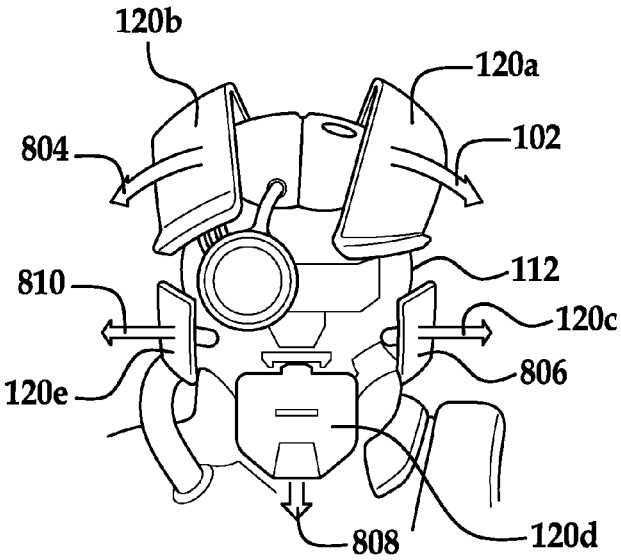

In one embodiment and as illustrated in FIGS. 8*a* and 8*b*, the head may include multiple moving portions. For example, in this embodiment, the head can have movable portions 120*a* and 120*b* that rotate laterally to expose the head, as indicated by arrows 802 and 804. Additional portions, such as portions 120*c-e* can move to expose other portions of the head, as indicated by arrows 806-810.

It will be appreciated that the head and body portion or any other portion of toy 100 may have any number of movable portions that move to expose or partially expose various portions of the toy in any manner desired or extended or separate from the toy in any manner desired. For example, the legs, the torso, the feet and any other portion may have movable portions thereon. Each of these movable portions may be activated by a specific trigger or switch or all movable portions may be activated by the same trigger or switch or any combination of movable portions may be activated by the same or different triggers.

In some embodiments, the mask portion and the movable chest portions and any other portions are tethered to the head and chest respectively; however, it is noted that they may be coupled or connected to the toy in any manner desired or they may not be coupled and be completely removable.

In other embodiments toy 100 may have a button or other device thereon that would allow the toy to engage in the simulating fight without the use of a platform.

Referring now to FIGS. 10-14B an alternative embodiment of the present invention is illustrated. In this embodiment, lateral, forward/rearward, rotational, twisting or side to side movement of the figure or robot is achieved by moving the robot at the feet instead of the waist. Accordingly and in accordance with exemplary embodiments of the present invention, the lateral, forward/rearward, rotational, twisting and/or side to side movement of the robot caused by actuation of the controller may occur at the feet of the robot or at the waist of the robot. In embodiments where the movement occurs at the feet of the robot a greater amount of overall movement at the upper portions of the robot is achieved since the entire length of the robot is used. See for example, the movements illustrated in FIG. 10A.

As illustrated, a game 200 is provided wherein a pair of fighting figures, robots, action figures or characters 202 are included in game 200. In the foregoing text the term robot will be used however exemplary embodiments of the present invention are not intended to be limited to robot figures as item 202 is intended to cover or refer to any type of figure, figurine, character, action figure, super hero, villain, humanoid, etc. having a head, a chest, legs and articulating arms to combat or fight with another similarly suited item. In one embodiment, robots 202 are movably secured to a platform 204 such that robots 202 may battle, fight or box each other by moving a controller 206 secured to each robot 202.

Movement of the robot is achieved in various methods wherein each method provides at least two different directions or types of movement. As illustrated, each controller 206 will have a movable yoke portion 208 having a pair of handles 210 secured to a shaft portion 212. Each handle (left and right) will have an actuation button 214, which when depressed will cause a corresponding arm (left or right) to punch outwardly from the body of the robot. Movement of the arms of the robot will be similar to that illustrated in U.S. Pat. Nos. 3,235,259 and 7,475,881 or equivalents thereof wherein depressing of button 214 causes mechanical linkage to move a corresponding arm in a punching fashion outwardly.

In addition, each shaft portion 212 is movably secured to a base member 216 that is also secured to a base 218 that each robot is secured to such that movement of the base member 216 in the direction of arrows 220 will cause a corresponding movement of the base 218 such that the robot moves accordingly. Again movement of base member 216 and base portion 218 is similar to that components illustrated in U.S. Pat. Nos. 3,235,259 and 7,475,881 or equivalents thereof, wherein base member 216 is movably secured to the platform and has one end extending outwardly from the platform and another end is movably disposed within the platform and is secured to base portion 218.

Figure 11:
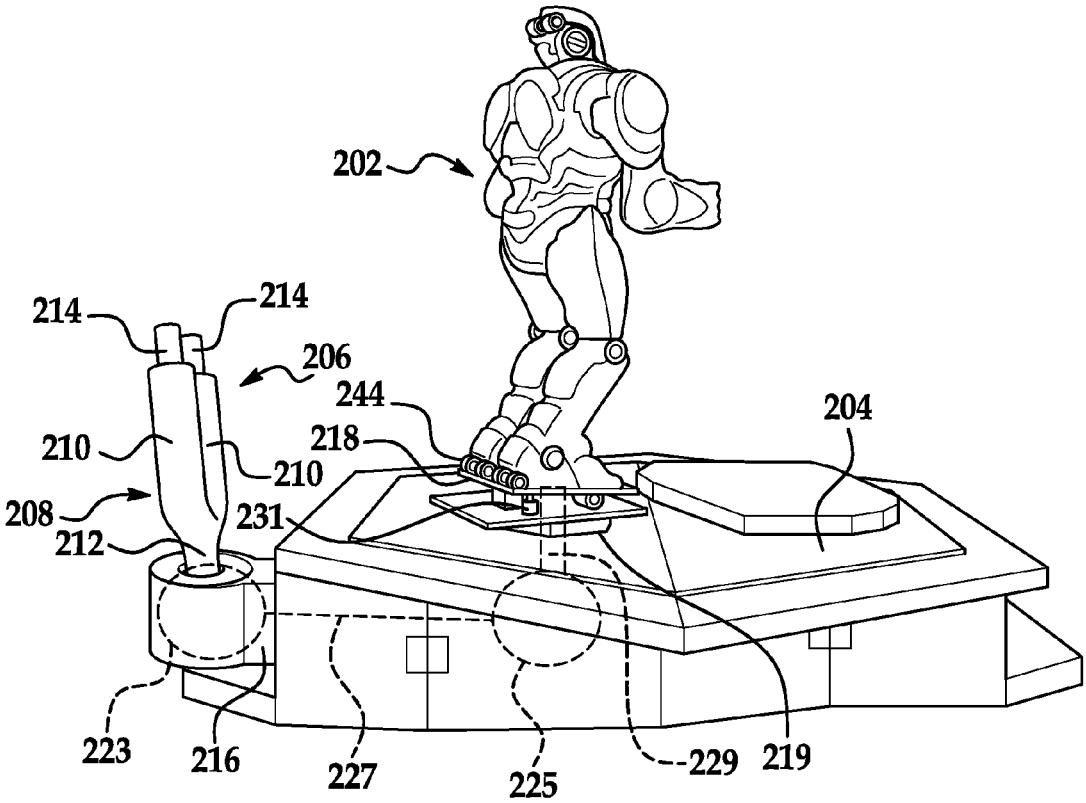
Figure 12:
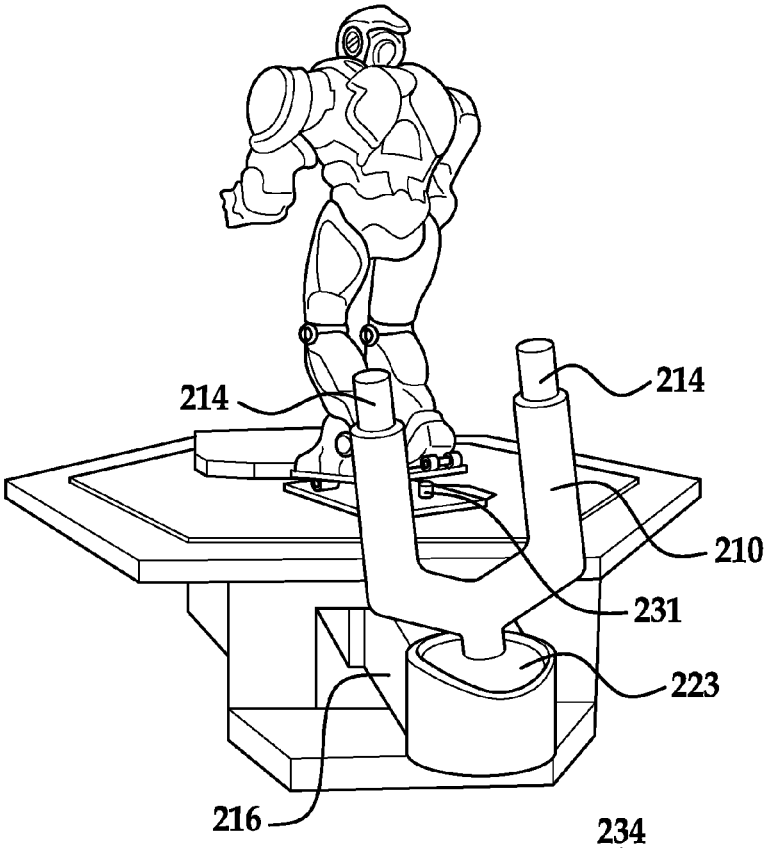

As shown in FIGS. 11 and 12 base portion 218 rests on top of platform 204 and has a periphery larger than an opening 219 such that movement of base member 216 will cause a corresponding movement of base portion 218 and controller 206. In one embodiment, this movement of the base portion and the connected controller and robot will be planar or a sliding movement with respect to the platform. It being understood that FIGS. 11 and 12 only shown one robot however exemplary embodiments contemplate one or more robots secured to the platform.

In addition, each controller 206 is also capable of moving various directions including those in the direction of arrows 222 or combinations thereof with respect to base member 216. As will be discussed herein and in accordance with an exemplary embodiment of the present invention, movement of the controller in the direction of arrows 222 will cause the feet 224 of the robot to move in a similar fashion see for example FIG. 10A. Movement of controller 206 in the direction of arrows 222 is facilitated by a first ball joint 223 that is movably received in an end of base member 216. In addition, ball joint 223 will be secured to linkage wherein movement of the ball joint 223 by moving controller 206 in the direction of arrows 222 will cause a corresponding movement of the robot. Accordingly, twisting or rotational movement of the controller is applied to the feet of the robot as well as side to side, forward, rearward and angular movement.

In one non-limiting embodiment, the first ball joint 223 is coupled to a second ball joint 225 by for example a linkage member 227. In one embodiment, linkage member comprises a pair of linkage members each having one end secured to a discrete portion of one ball joint and the other end secured to a discrete portion of the other ball joint. In one configuration the ends of the linkage members are secured to opposite sides of the ball joints. Of course, numerous types of linkage members are contemplated as long as rotational movement of one ball joint is transferred to the other ball joint. The rotational movement of the ball joint or equivalent devices allows almost any type of angular movement of the controller to be applied to the portion of the robot the second ball joint is secured to. Second ball joint 225 is secured to a platform or base the feet 224 of the robot are secured to by for example a shaft 229 or any other suitable type of connection thus, movement of ball joint 223 in any direction including those of arrows 222 and combinations thereof will cause a corresponding movement of ball joint 225 and ultimately a corresponding movement of the robot. As illustrated, the platform shaft 229 is secured will be in a spaced relationship with respect to the platform or surface of the arena the robot is movably received in to allow for the angular movement of the ball joint 225 to be applied to platform 218 thus allowing the robot to twist, lean and move as the controller is moved. As illustrated schematically, the second ball joint is movably received within base member 216 below the robot's feet. In addition, the second ball joint is fixedly secured to the robot's feet or other equivalent body portion such that movement of the second ball joint within member 216 will cause a corresponding movement of the robot's feet. Of course, other alternative arrangements are contemplated for translating the movement of controller 206 into a corresponding movement of the robot for example, the waist connection as mentioned above.

In order to move the robot a player moves the controller to the left or right with respect to the base member 216 and this movement will cause the feet 224 and robot 202 to move to the left or right. In addition, movement of the controller back and forth will cause the feet and the robot to lean forward or backward (See for example the movement illustrated in FIG. 10A). In addition, rotational or twisting motions may also be transferred. Accordingly and during game play, each user 226 can grip the controller and move the base member 216 in any direction including those of arrows 220 and combinations thereof to move their robot in various directions while also moving controller in various directions including those of arrows 222 and combinations thereof to cause their robot to advance (e.g., lean) during attacks and/or dodge (e.g., lean) during counter attacks or rotate or twist. In other words, movement of the robot may be caused by sliding the base member and accordingly the robot and the controller in the direction of arrows 220 while also moving the controller in the direction of arrows 222 to cause a similar movement (e.g., twisting, leaning forward, backward, left, right, etc.) of the robot with respect to the base member. A schematic illustration of this movement is also illustrated in FIG. 14B.

In addition, each user also depresses buttons 214 in order to punch an opposing robot while the other user moves their controller and their base member to move their robot away from an opponent's punches. Actuation of buttons 214 will cause the robot's arms to articulate or punch outwardly using linkages similar to those illustrated in U.S. Pat. Nos. 3,235,259 and 7,475,881 or any equivalent mechanisms. In one embodiment, actuation of buttons 214 will cause a piston or feature 231 to move upwardly and into an opening in the feet of the robot to manipulate a linkage that when manipulated causes the robot's arm to articulate outwardly and return to a non-punching position when button 214 is released.

In this illustrated embodiment, each robot 202 will have an actuation button, switch or sensor 230 on a chest portion 232 of the robot. In one non-limiting exemplary embodiment, the goal of the game will be to punch an opposing player's chest such that when button 230 is depressed the robot whose button is depressed will be defeated. As illustrated, depressing of button 230 from a first position to a second position will cause one or several functions to occur in the defeated robot. For example, one function will be the deflection of movable chest portions 234 of the robot in the directions of arrows 236.

Figure 10:
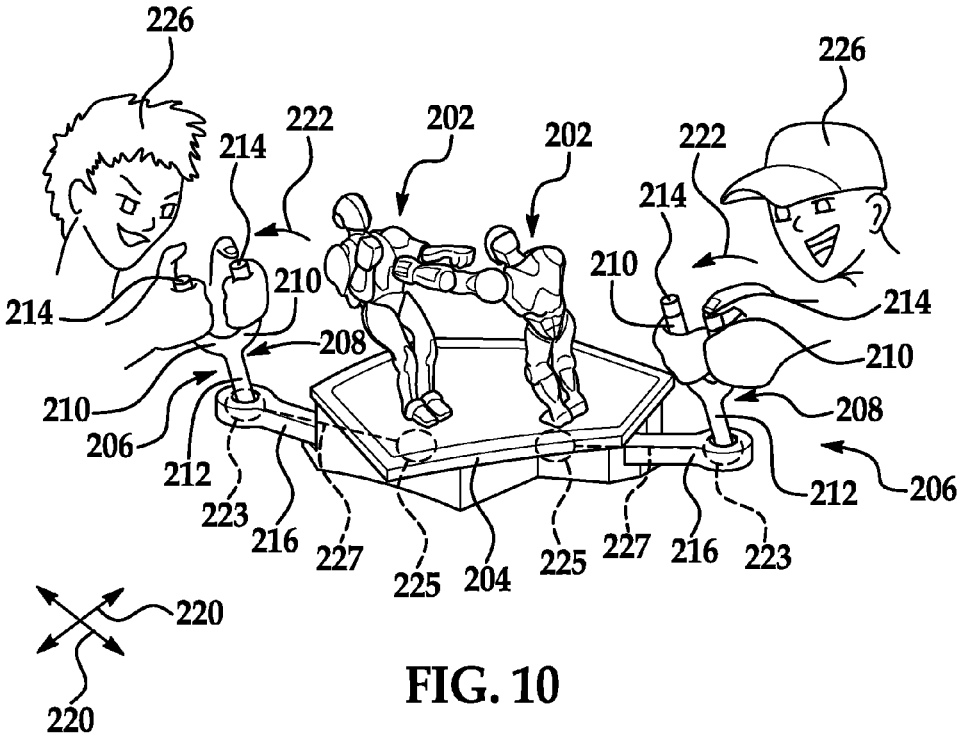
FIGS. 10, 10A-10D, 11-13, 14A and 14B illustrate alternative exemplary embodiments of the present invention.
Figure 10A:
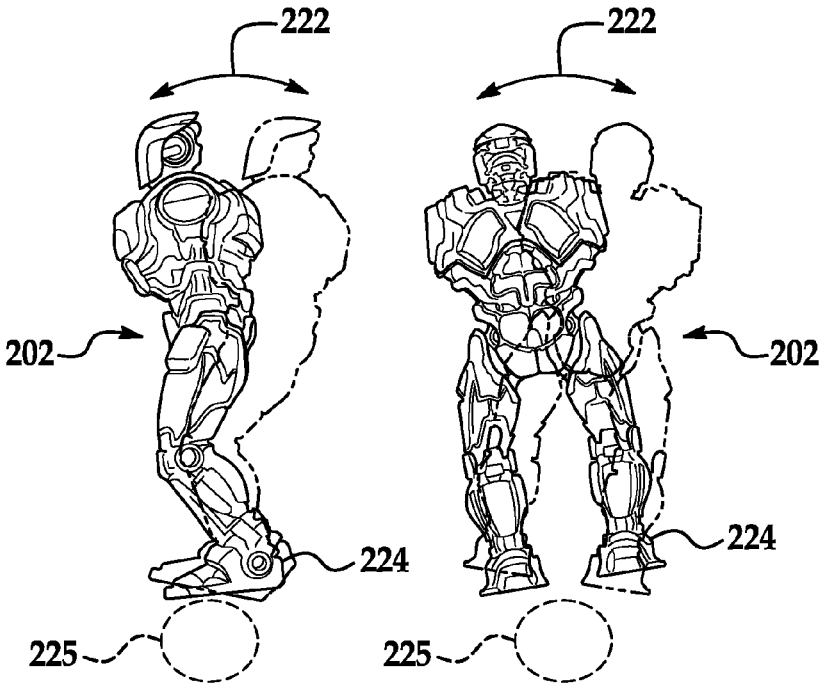
Figure 10B:
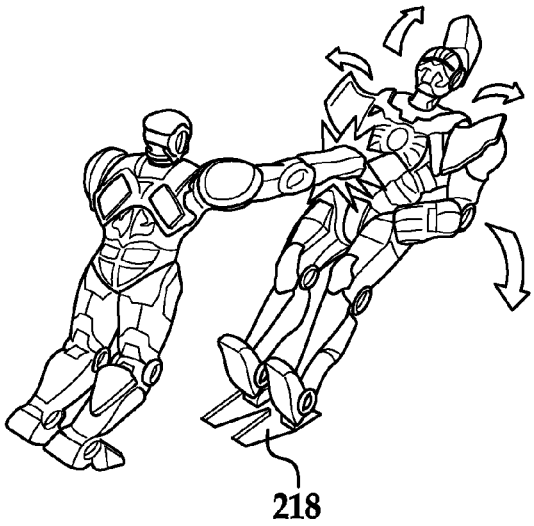
Figure 10C:
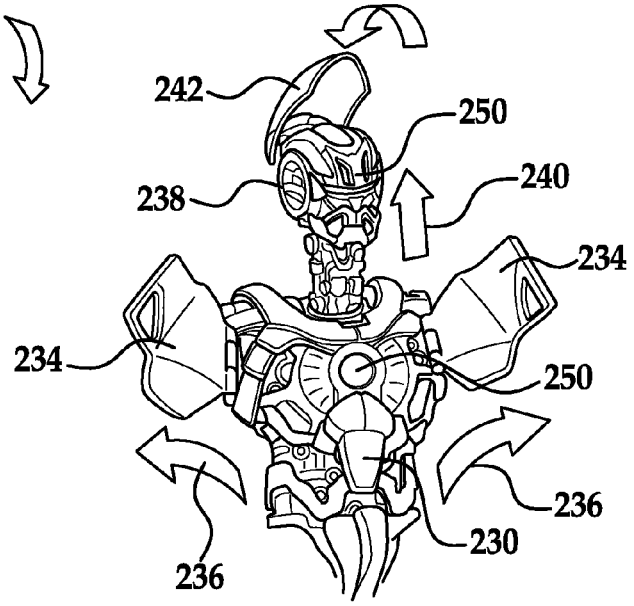
Figure 10D:
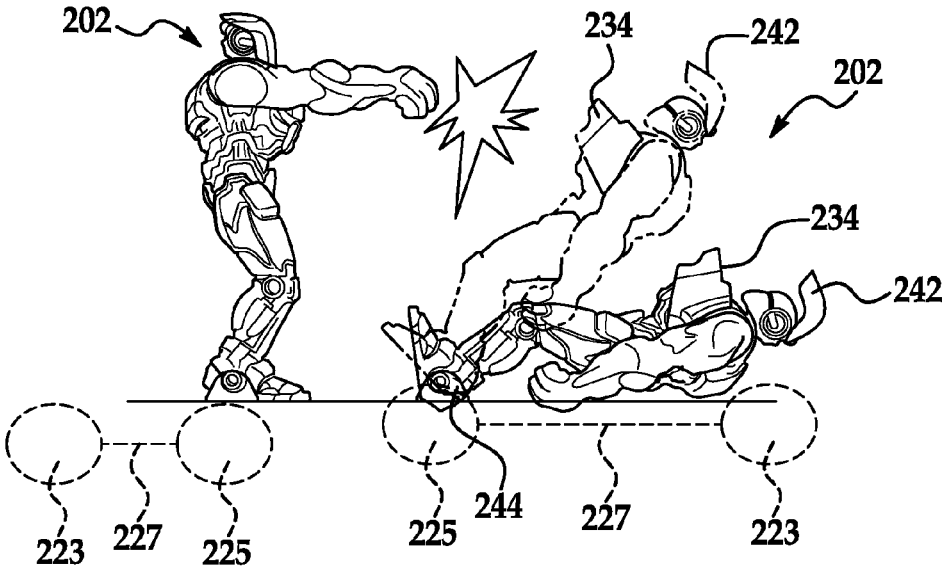

As discussed above, chest portions 234 may be spring biased in the direction of arrows 236 and pivotally connected to the chest for movement from a closed or latched position (FIGS. 10-10A) to an open position (FIGS. 10B-10D) when button 230 is depressed. Depression of button 230 from the first position to the second position causes the chest portions to no longer be latched and open into the positions illustrated in FIG. 10B-10D. In addition and as illustrated in FIGS. 10B and 10C and as discussed above, depression of button 230 will cause a head 238 of the robot to extend upwardly in the direction of arrow 240 and a visor 242 will move from a closed position FIGS. 10 and 10A) to an open position (FIGS. 10B and 10C) thereby exposing the face of the robot.

In one non-limiting exemplary embodiment, the visor will be spring biased into the open position and actuation of the button will allow the visor to move from a closed or latched position to an open or defeated position. Actuation of button 230 and corresponding linkage may be similar to the mechanism illustrated in U.S. Pat. No. 7,475,881 or any other suitable linkage for translating movement of the button to spring biased features (e.g., chest, head, visor, feet, etc.) of the robot wherein depression of the button releases the spring biased features.

Figure 13:
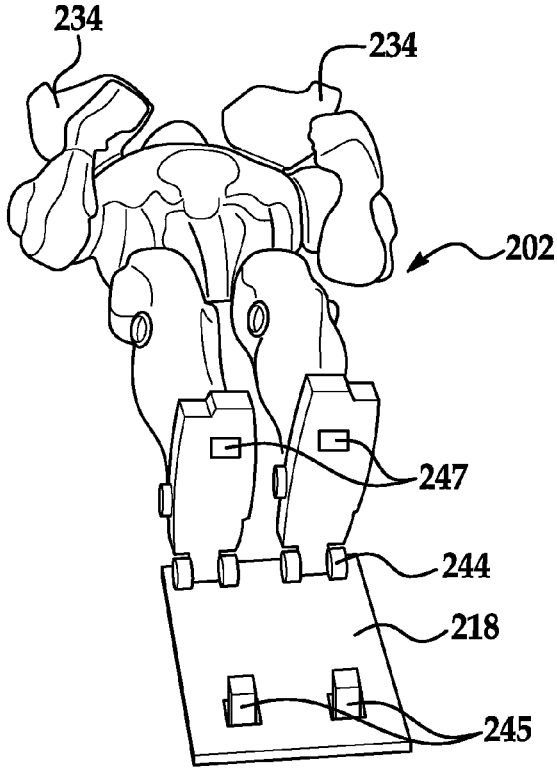

In addition, still another defeated position of the robot is achieved by actuation of the button 230. Here the robot's feet will be pivotally or hingeably secured to platform 218 by a hinge 244 such that actuation of button 230 will cause the feet to no longer be secured to the platform at one end and pivot towards the defeated position illustrated in FIG. 10B. FIG. 13 also shows the robot in the defeated position wherein the robot's feet are no longer coupled to the platform other than by hinge 244. In this embodiment, the feet are latched to the platform by features 245 that engage openings 247 in the feet and actuation of the button causes the latch to be released through actuation of internal linkage in the robot and allow the body to pivot into the collapsed or defeated position illustrated in FIGS. 10B and 10D.

In an alternative embodiment, the feet are merely latched to the base by spring biased features 245 that engage openings 247 and a force in the center of the robot's chest will be enough to overcome the biasing force of features 245 and the robot will fall backwards into the defeated position. In any of the aforementioned features wherein pivoting portions of the robot are released the same are capable of being returned to their unreleased position by latching to or engaging movable features. These features move and release the pivoting portions of the robot due to actuation of the button 230 this depression of button 230 causes the movable features to release the pivoting portions, which in some embodiments are spring biased into the open or released position to provide dramatic effect.

Accordingly, depression of button 230 on either robot will cause anyone of the aforementioned actions to occur independently or any combination of the three actions (e.g., chest expanding, head extending with visor flipping and robot collapsing) occurring simultaneously.

Figure 14A:
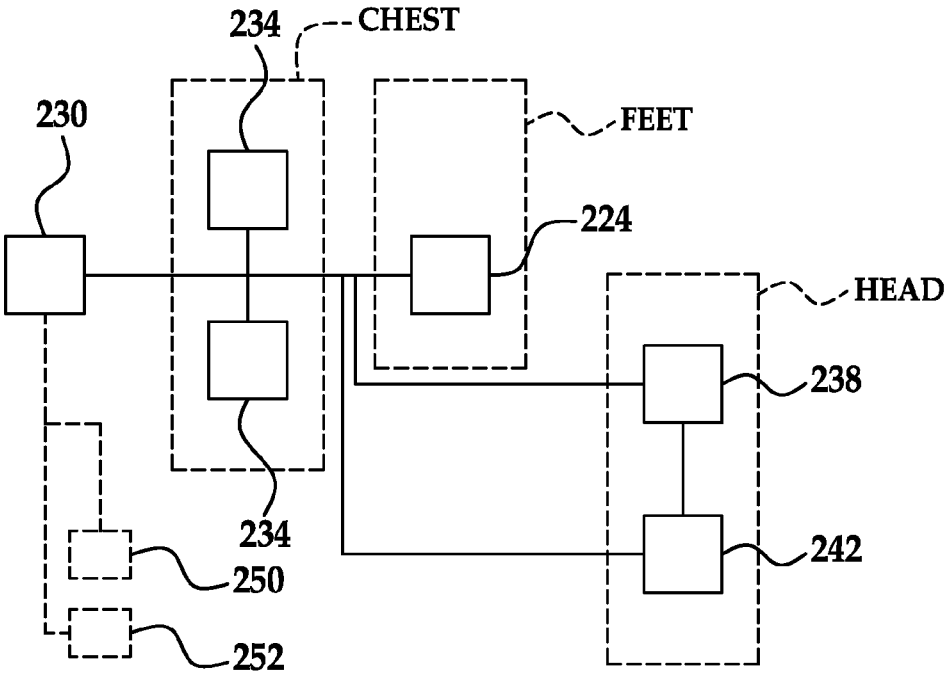
Figure 14B:
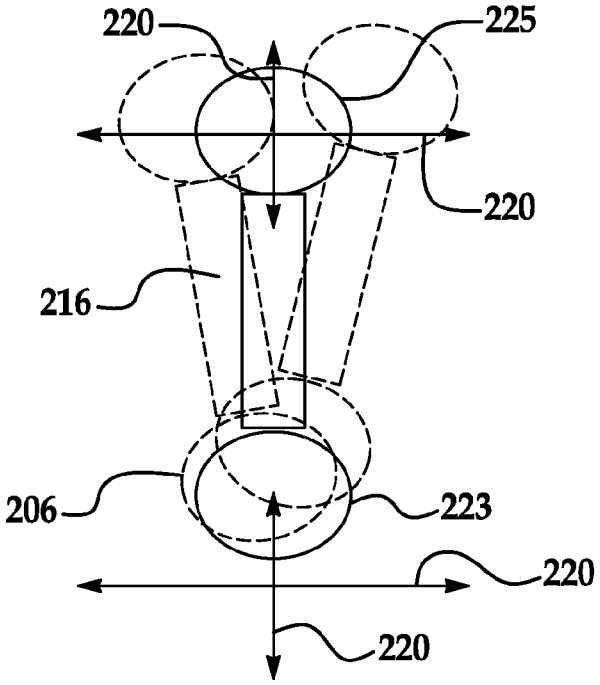

FIG. 14A schematically illustrates the effects that occur when button 230 of each robot or at least one robot is depressed by linking button 230 to features found in the chest, feet and head of the robot (e.g., movement of chest portions 234, feet 224, head 238 and visor 242). As illustrated, button 230 is linked to the chest portions 234, the feet 224, head 238 and visor 242 via any suitable mechanism activation mechanism or linkage schematically represented by the lines in FIG. 14A such that manipulation of button 230 will release the chest portions 234, the feet 224, head 238 and visor 242 from a latched or closed position. As discussed above any of the aforementioned portions (e.g., 234, 224, 238 and 242) pivotally or movably secured to the robot may be spring biased into the open or released position such that actuation of button 230 allows the same to spring, pivot or move into the open positions illustrated herein. Thereafter, these features are then returned to their closed position for rerelease during button activation during continued game play. Of course, numerous variations are contemplated wherein actuation of button may only cause one effect to occur or any combination of effects to occur either simultaneously or sequentially in order to provide for enhanced game play. FIG. 14B schematically illustrates the sliding or planar movement of the robot by moving base member in the directions of arrows 220 to cause the robot and the controller to move the positions illustrated by the dashed lines in FIG. 14B while FIGS. 10-10B illustrate movement of the robots with respect to the base member by corresponding movement of the controller with respect to the base member.

In one alternative exemplary embodiment, an LED 250 is located in either the head or chest or both and the LED(s) (powered by a power supply) flashes during game play to simulate a "life force" of the robot. During game play and if the robot was hit at button 230 the LED would flicker and go out.

In still another embodiment, the robots are equipped with sound effects to be played by speaker(s) 252 disposed within or around the game. In one embodiment a recording of a ratchet noise similar to that used in the game depicted in U.S. Pat. No. 3,235,259 is played when button 230 is depressed to simulate the sound effects generated when the spring mechanisms of the aforementioned patent were activated. LED 250 and speakers 252 are illustrated schematically in FIG. 14A by the dashed lines. Again activation of the sound effects and/or blinking and turning off of the LED occurs when button 230 is depressed such that a switch closes or opens a circuit to achieve the desired effect. Here button and or switch 230 may be coupled to the speaker and/or LED by a wire or other suitable conductive member represented by the lines connecting button 230 to LED 250 and speaker 252.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A toy figure for use in a game, comprising:

a body portion movably secured to a base member, the body portion being coupled to a controller, which is also movably secured to the base member, the base member supporting the controller and the body portion, wherein movement of the controller with respect to the base member causes a corresponding movement of the body portion with respect to the base member and movement of the base member causes a corresponding movement of the body portion and the controller; and a button disposed on the body portion, the button being capable of movement from a first position to a second position wherein movement of the button from the first position to the second position causes a pair of body parts pivotally secured to the body portion to pivot from a closed position to an open position, wherein the controller is movably secured to the base member by a first ball joint and the body portion is movably secured to the base member by a second ball joint, wherein the first ball joint is coupled to the second ball joint.

2. The toy figure as in claim 1, wherein movement of the button from the first position to the second position causes a head movably secured to the body portion to move from a non-extended position with respect to the body portion to an extended position with respect to the body portion.

3. The toy figure as in claim 2, wherein a visor is pivotally secured to the head, the visor being capable of being moved from a head covering position to a head uncovered position, wherein the visor pivots from the head covering position to the head uncovered position when the button moves from the first position to the second position.

4. The toy figure as in claim 1, wherein the body portion further comprises a chest portion, a pair of arms, a pair of legs and a head, the pair of arms being movably secured to the chest portion, the pair of legs being secured to the base member and the head being movable from an extended position with respect to the body portion and a non-extended position with respect to the body portion.

5. The toy figure as in claim 1, wherein the controller further comprises a yoke having a pair of handles each being secured to a shaft portion, wherein the shaft portion is movably secured to the base member by the first ball joint and the body portion is movably secured to the base member by the second ball joint.

6. The toy figure as in claim 5, wherein the body portion further comprises a chest portion, a pair of arms, a pair of legs and a head, the pair of arms being movably secured to the chest portion, the pair of legs being movably secured to the base member and the head being movable from an extended position with respect to the body portion and a non-extended position with respect to the body portion.

7. The toy figure as in claim 6, wherein the pair of handles each further comprise an actuation button for manipulating one of the pair of arms when the actuation button is depressed.

8. The toy figure as in claim 1, wherein the body portion further comprises a chest portion, a pair of arms, a pair of legs and a head, the pair of arms being movably secured to the chest portion, the pair of legs being secured to the chest portion and the base member and the head being movable from an extended position with respect to the body portion and a non-extended position with respect to the body portion, wherein the pair of legs are pivotally secured to the base member by a hinge and the body portion of the toy figure is capable of being moved from an upright position to a non-upright position when the body portion pivots with respect to the base member.

9. The toy figure as in claim 1, further comprising a platform wherein a first end portion of the base member extends outwardly away from the platform and an opposite end portion of the base member extends through an opening in the platform and rests on top of a surface of the platform, wherein the opening allows the base member to move with respect to the platform.

10. The toy figure as in claim 1, wherein the body portion further comprises a chest portion and a leg portion and wherein the chest portion is movably secured to the leg portion and movement of the controller with respect to the base member causes a corresponding movement of the chest portion with respect to leg portion.

11. A game, comprising:

a base;

a first fighting figure movably secured to the base, the first fighting figure comprising:

a body portion coupled to a controller movably secured to a base member that is fixedly secured to the body portion, wherein movement of the controller with respect to the base member causes a corresponding movement of the body portion with respect to the base member and movement of the base member causes a corresponding movement of the body portion and the controller, wherein the controller is movably secured to the base member by a first ball joint and the body portion is movably secured to the base member by a second ball joint, wherein the first ball joint is coupled to the second ball joint;

a button disposed on the body portion, the button being capable of movement from a first position to a second position wherein movement of the button from the first position to the second position causes a pair of body parts pivotally secured to the body portion to pivot from a closed position to an open position; and a second fighting figure movably secured to the base, the second fighting figure comprising:

a body portion coupled to a controller movably secured to a base member that is fixedly secured to the body portion, wherein movement of the controller with respect to the base member causes a corresponding movement of the body portion with respect to the base member and movement of the base member causes a corresponding movement of the body portion and the controller, wherein the controller is movably secured to the base member by a first ball joint and the body portion is movably secured to the base member by a second ball joint, wherein the first ball joint is coupled to the second ball joint; and a button disposed on the body portion, the button being capable of movement from a first position to a second position wherein movement of the button from the first position to the second position causes a pair of body parts pivotally secured to the body portion to pivot from a closed position to an open position.

12. The game as in claim 11, wherein movement of the button from the first position to the second position causes a head movably secured to the body portion to move from a non-extended position with respect to the body portion to an extended position with respect to the body portion.

13. The game as in claim 11, wherein a visor is pivotally secured to the head, the visor being capable of being moved from a head covering position to a head uncovered position, wherein the visor pivots from the head covering position to the head uncovered position when the button moves from the first position to the second position.

14. The game as in claim 11, wherein the body portion further comprises a chest portion, a pair of arms, a pair of legs and a head, the pair of arms being movably secured to the chest portion, the pair of legs being secured to the base member and the head being movable from an extended position with respect to the body portion and a non-extended position with respect to the body portion.

15. The game as in claim 11, wherein the controller further comprises a yoke having a pair of handles each being secured to a shaft portion, wherein the shaft portion is movably secured to the base member by the first ball joint and the body portion is movably secured to the base member by the second ball joint.

16. The game as in claim 11, wherein the body portion further comprises a chest portion, a pair of arms, a pair of legs and a head, the pair of arms being movably secured to the chest portion, the pair of legs being secured to the chest portion and the base member and the head being movable from an extended position with respect to the body portion and a non-extended position with respect to the body portion, wherein the pair of legs are pivotally secured to the base member by a hinge and the body portion of the toy figure is capable of being moved from an upright position to a non-upright position when the body portion pivots with respect to the base member.

* * * * *